US009398658B2

(12) United States Patent
Angelin et al.

(10) Patent No.: US 9,398,658 B2
(45) Date of Patent: Jul. 19, 2016

(54) LIGHTING MODULE AND CORRESPONDING LIGHTING SYSTEM

(71) Applicant: OSRAM GmbH, Munich (DE)

(72) Inventors: Francesco Angelin, Mogliano Veneto (IT); Paolo De Anna, Vallàdi Riese Pio X (IT); Hannes Wagner, Puchheim (DE)

(73) Assignee: OSRAM GMBH, Munich (DE)

( * ) Notice: Subject to any disclaimer, the term of this patent is extended or adjusted under 35 U.S.C. 154(b) by 36 days.

(21) Appl. No.: 14/300,270

(22) Filed: Jun. 10, 2014

(65) Prior Publication Data

US 2014/0361693 A1 Dec. 11, 2014

(30) Foreign Application Priority Data

Jun. 10, 2013 (IT) ..... TO2013A0475

(51) Int. Cl.
*H05B 33/08* (2006.01)

(52) U.S. Cl.
CPC ..... *H05B 33/0842* (2013.01); *H05B 33/0845* (2013.01)

(58) Field of Classification Search
CPC ..... H05B 33/0842
USPC ..... 315/152, 191, 294, 297
See application file for complete search history.

(56) References Cited

U.S. PATENT DOCUMENTS 8,564,210 B2 * 10/2013 Hamamoto ..... F21K 9/17 315/185 R
2005/0062445 A1 * 3/2005 Toyota ..... H05B 33/0803 315/312
2011/0210675 A1 9/2011 Hamamoto et al.
2012/0068627 A1 * 3/2012 Brooks ..... H05B 33/0812 315/309

FOREIGN PATENT DOCUMENTS

EP 1517588 A1 3/2005
EP 2432299 A1 3/2012
WO 0101385 A1 1/2001
WO 0223956 A2 3/2002

OTHER PUBLICATIONS

Search Report issued in the corresponding Italian application No. TO20130475, dated Feb. 4, 2014.

* cited by examiner

*Primary Examiner* — Douglas W Owens
*Assistant Examiner* — Pedro C Fernandez
(74) *Attorney, Agent, or Firm* — Viering, Jentschura & Partner mbB

(57) ABSTRACT

A lighting module may include at least one light source, and an identification element that identifies the supply current required by the light source, wherein the identification element includes a first terminal and a second terminal for connection to an electronic converter.

In particular, the identification element includes at least one shunt regulator configured for limiting the voltage across the first terminal and the second terminal to a maximum threshold voltage, wherein the maximum threshold voltage identifies the supply current required by the light source.

11 Claims, 7 Drawing Sheets

LIGHTING MODULE AND CORRESPONDING LIGHTING SYSTEM

CROSS-REFERENCE TO RELATED APPLICATION

This application claims priority to Italian Patent Application Serial No. TO2013A000475, which was filed Jun. 10, 2013, and is incorporated herein by reference in its entirety.

TECHNICAL FIELD

Various embodiments relate to lighting systems.

The description has been developed with particular attention paid to its possible use for identifying operating parameters of lighting modules.

BACKGROUND

Electronic converters for light sources that comprise, for example, at least one LED (Light-Emitting Diode) or other solid-state lighting means, can supply at output a d.c. current. Said current may be stable or even vary in time, for example, for adjusting the intensity of the light emitted by the light source (the so-called "dimming function").

FIG. 1 shows a possible lighting system including an electronic converter 10 and a lighting module 20 comprising, for example, at least one LED L.

FIG. 2 shows an example of a lighting module 20 that comprises a LED string, i.e., a plurality of LEDs connected in series. For instance, in FIG. 2 four LEDs L1, L2, L3 and L4 are shown.

The electronic converter 10 usually comprises a control circuit 102 and a power circuit 12 (for example, an AC/DC or DC/DC switching supply), which receives at input a voltage or generally a supply signal (for example, from the electric power line) and supplies at output, via a power output 106, a d.c. current. Usually, the power output 106 comprises two power supply terminals or lines, wherein the negative terminal represents a ground GND. This current may be stable or even vary over time. For instance, the control circuit 102 can set, via a reference channel Iref of the power circuit 12, the current required by the LED module 20.

For instance, this reference channel Iref may be used for adjusting the intensity of the light emitted by the lighting module 20. In fact, in general, an adjustment of the intensity of light emitted by the LED module 20 can be made by adjusting the average current that traverses the lighting module, for example by setting a lower reference current Iref or activating or de-activating the power circuit 12 through a signal with a pulse-width modulation (PWM).

In general, the LED module 20 may also comprise an identification element 202 that identifies the current required by the lighting module 20 (or in general control parameters). In this case, the control circuit 102 communicates with the identification element 202 and adapts operation of the electronic converter 10.

For instance, FIG. 3 illustrates an embodiment in which the identification element 202 comprises a simple resistor Rset.

In this case, the control unit 102 can measure the resistance of the resistor Rset and adapt operation of the power circuit 12 as a function of the resistance detected. For instance, in the example considered, the resistor Rset is connected to the control unit 102 by means of two terminals or lines S1 and S2. Typically, the line S2 is connected to ground GND and consequently could be also provided only the measuring line S1.

For instance, in the example considered, the control unit 102 comprises a pull-up resistor R1 connected in series with the resistor Rset. In this case, the voltage divider, comprising the resistors R1 and Rset, can be supplied via a voltage Vcc, and the voltage Vset at the intermediate point between the resistors R1 and Rset, i.e., on the line S1, identifies the resistance of the resistor Rset.

Instead, FIG. 4 shows an example where the resistor Rset is directly supplied through a current generator that generates a reference current Iset.

In general, the identification element 202 may also comprise a temperature sensor. For instance, this may be useful for varying the supply current on the line 106 as a function of the temperature of the lighting module 20 and/or for deactivating supply in the event of overheating of the lighting module 20.

For instance, FIG. 5 shows an identification element 202 that comprises both a resistor Rset for setting the nominal current and a temperature sensor TS, such as for example a thermistor of the negative-temperature-coefficient (NTC) type. For instance, in the embodiment considered, the NTC thermistor is connected between an auxiliary line AUX and the line S2, and the resistance of the NTC thermistor can be measured as the resistance of the resistor Rset.

In general, the value of the resistance between the measuring lines S1 and S2 could be varied also directly as a function of the temperature of the lighting module 20. Consequently, in general, the resistance of the resistor Rset or the resistance between the lines S1 and S2 is not necessarily fixed, but could also vary during operation.

The solutions described previously may also be used when a plurality of lighting modules 20 is connected in parallel.

For instance, FIG. 6 shows an example in which two lighting modules 20*a* and 20*b* are connected in parallel between the line 106 and ground GND.

In this case, also the respective identification elements 202*a* and 202*b* can be connected in parallel. In this way, the resistance detected between the lines S1 and S2 always identifies the global current required by the lighting modules 20, i.e., the sum of the current required by the module 20*a* and the current required by the module 20*b*.

However, the inventors have noted that the solutions described previously cannot be used when the lighting modules 20 are connected in series.

For instance, FIG. 7 shows an example in which two lighting modules 20*a* and 20*b* are connected in series between the line 106 and ground GND.

The inventors have noted that in this case the current supplied by the electronic converter 12 should be set at the minimum value required by one of the lighting modules 20*a* and 20*b*. However, this cannot be obtained either with a connection in series or with a connection in parallel of the identification elements 202*a* and 202*b* when these are resistors.

SUMMARY

According to various embodiments, the above object is achieved thanks to a lighting module having the characteristics recalled in the ensuing claims. The claims also regard a corresponding lighting system.

In particular, the inventors have noted that, in the case where the lighting modules are connected in series, setting of the current may be made by means of a regulator, such as a shunt-regulator, frequently also referred to as "regulator of the parallel type", or a Zener diode.

In various embodiments, the lighting module may include at least one light source, such as for example a LED or a LED string, and an identification element that identifies at least the supply current required by the light source. In particular, the identification element may include a first terminal and a second terminal for connection to an electronic converter, e.g. via respective measurement lines.

In various embodiments, the identification element may include at least one regulator, such as for example a shunt regulator or a Zener diode, configured for limiting the voltage across the two terminals to a maximum threshold voltage that identifies the supply current required by the light sources.

In various embodiments, the identification element may include a regulator, such as a shunt regulator, configured for varying its maximum threshold voltage, for example, as a function of the temperature of the lighting module and/or of the light source.

For instance, in one embodiment, the identification element may include a first regulator, e.g. a first shunt regulator, with a maximum threshold voltage that identifies the nominal current required by the light source, and a second regulator, e.g. a second shunt regulator, configured for varying its maximum threshold voltage, for example, as a function of the temperature of the lighting module and/or of the light sources. Typically, the shunt regulators are in this case connected in parallel.

Consequently, the second shunt regulator can reduce the voltage across the two terminals when the lighting module and/or the light sources are warming up. For instance, in one embodiment, the identification element may include an electronic switch that shortcircuits the two terminals when the temperature of the lighting module and/or of the light sources exceeds a temperature threshold.

Instead, the electronic converter may include a power circuit for supplying the light source of the lighting module and a control circuit that detects the voltage across the two terminals of the identification element and sets the output current of the power circuit in such a way that the current supplied varies as a function of the voltage detected. Usually, the electronic converter comprises at least:

- two power supply terminals for connection of the power circuit to the light sources, e.g. via respective power supply lines, and
- two (additional) measurement terminals for the connection of the control circuit to the identification element, e.g. via respective measurement lines.

For instance, typically, the control circuit sets the output current of the power circuit in such a way that the current supplied corresponds to the current identified through the voltage across the two terminals. However, in general, the control circuit could also deactivate the current supplied by the power circuit when the voltage detected has untypical values, for example when the voltage detected is lower than a first threshold (typical for an overheating or some other malfunctioning of the lighting module) and/or higher than a second threshold (which is typical of the case where no lighting module is connected to the power supply).

Consequently, when a plurality of lighting modules is connected to the electronic converter, where the light sources are connected in series between the power supply lines and the identification elements are connected in parallel between the measurement lines, the voltage across the two terminals (and thus the measurement lines) is set at the minimum value of the threshold voltages of the various identification elements; i.e., the electronic converter supplies a current via the power supply lines that corresponds to the minimum current required.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

In the ensuing description various specific details are illustrated aimed at providing an in-depth understanding of the embodiments. The embodiments may be obtained without one or more of the specific details, or with other methods, components, materials, etc. In other cases, known structures, materials or operations are not shown or described in detail so that various aspects of the embodiments will not be obscured.

Reference to "an embodiment" or "one embodiment" in the framework of the present description is intended to indicate that a particular configuration, structure, or characteristic described in relation to the embodiment is comprised in at least one embodiment. Hence, phrases such as "in an embodiment" or "in one embodiment" that may be present in various points of this description do not necessarily refer to one and the same embodiment. Furthermore, particular conformations, structures or characteristics may be combined adequately in one or more embodiments.

The references used herein are only provided for convenience and hence do not define the sphere of protection or the scope of the embodiments.

As mentioned previously, the present disclosure provides solutions that make it possible to obtain identification elements for lighting modules that are connected in series.

Figure 8:
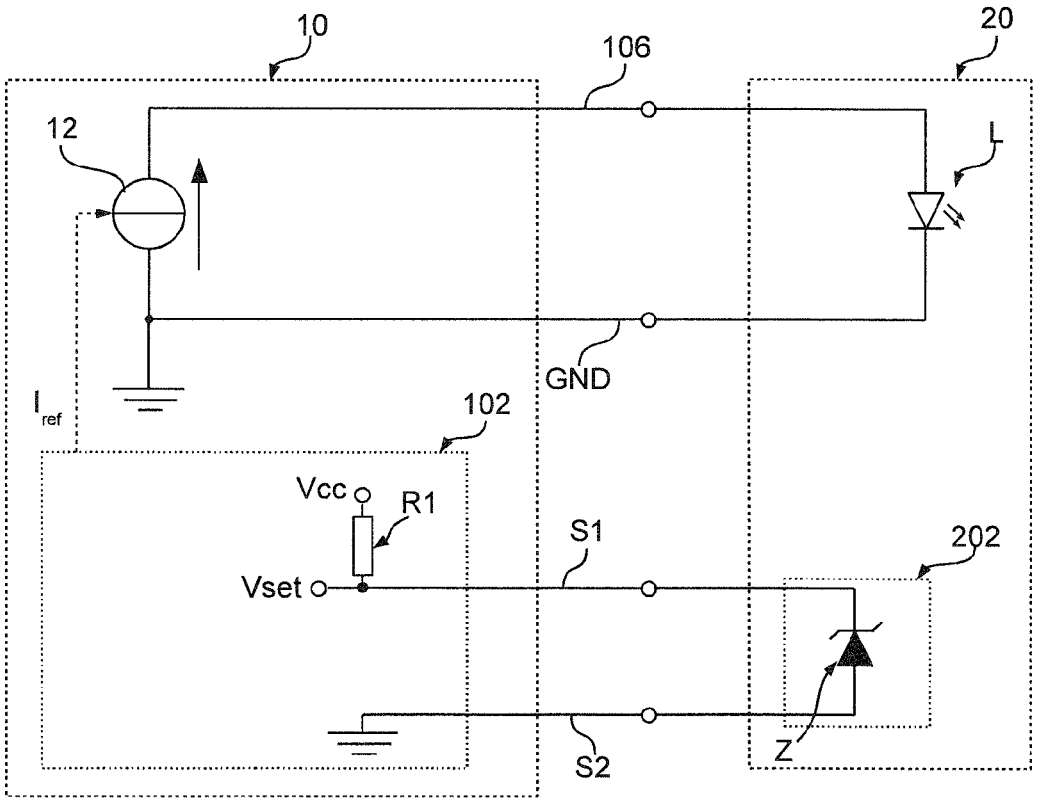
FIGS. 8 to 13 show details of embodiments of identification elements according to the present disclosure.

FIG. 8 illustrates an embodiment of an identification element according to the present disclosure.

In the embodiment considered, the light sources L of the lighting module 20 are connected between the power supply terminals 106 and the identification element 202 is connected, as previously, to the control unit 102 through two lines S1 and S2. Thus, the relative description concerning the technological background will not be repeated, and the same reference signs will be used for identical or functional similar or equivalent components.

Accordingly, also in this case, the electronic converter 10 and the lighting module 20 comprise at least:

- two power supply terminals 106 for connection of the power circuit 12 to the light sources L, e.g. via respective power supply lines, and
- two (additional) measurement terminals S1 and S2 for connection of the control circuit 102 to the identification element 202, e.g. via respective measurement lines.

However, in this case, no resistor is connected between the lines S1 and S2, but a Zener diode Z, where the threshold voltage of the Zener diode Z identifies the current required by the lighting module 20, i.e. the current required by the light sources L. In general, instead of a Zener diode Z also any other regulator, such as a shunt regulator, that enables limitation of the voltage across the terminals S1 and S2 to a given maximum threshold voltage could be used. For instance, in one embodiment, an integrated circuit of the LM431 type is used as shunt regulator.

Figure 1:
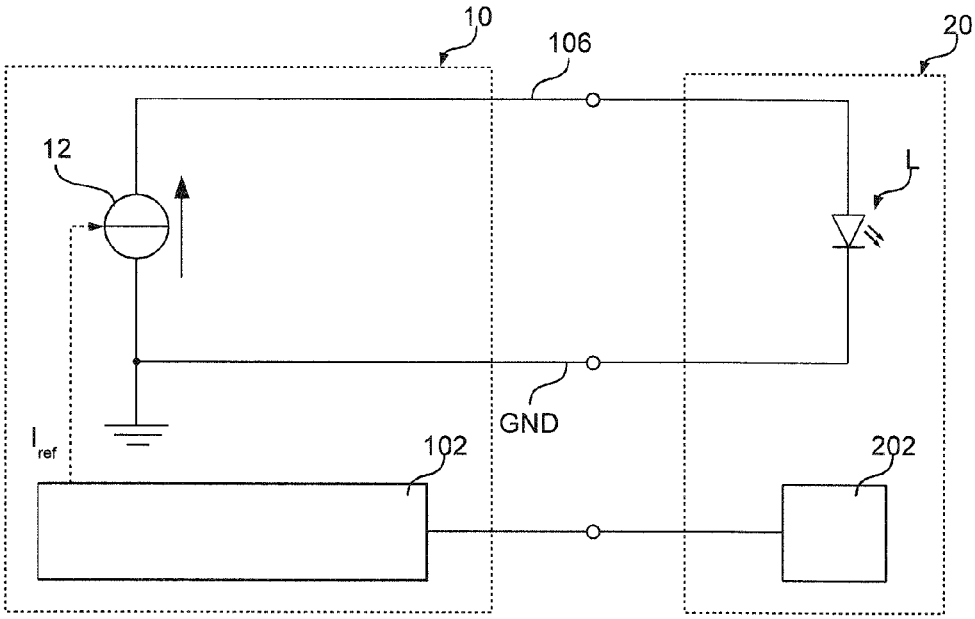
Prior Art Fig. 1
FIGS. 1 to 7 have already been described previously.
Figure 2:
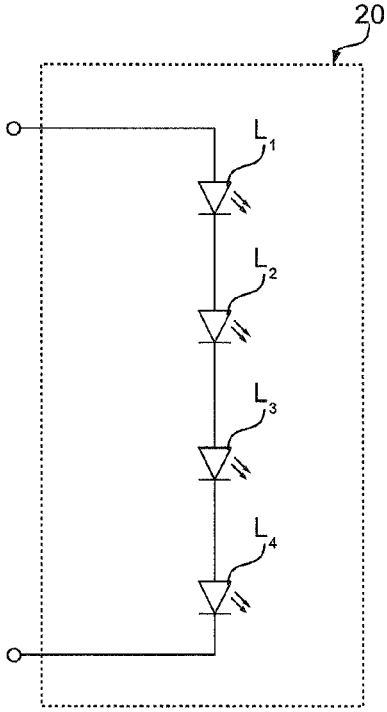
Prior Art Fig. 2
Figure 3:
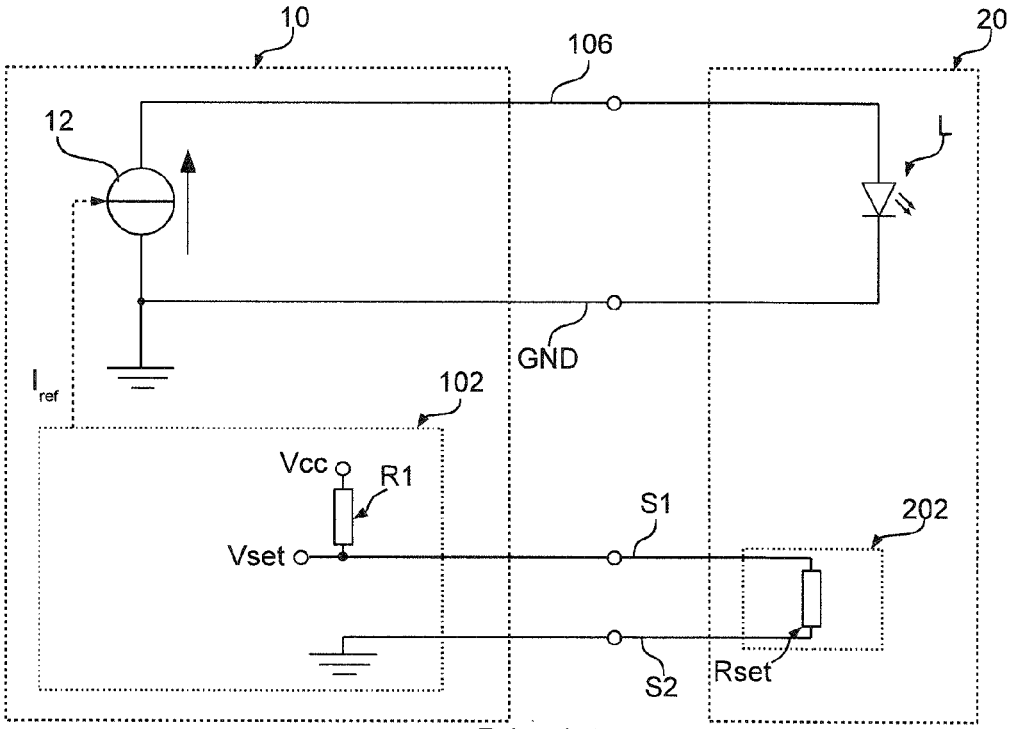
Prior Art Fig. 3
Figure 4:
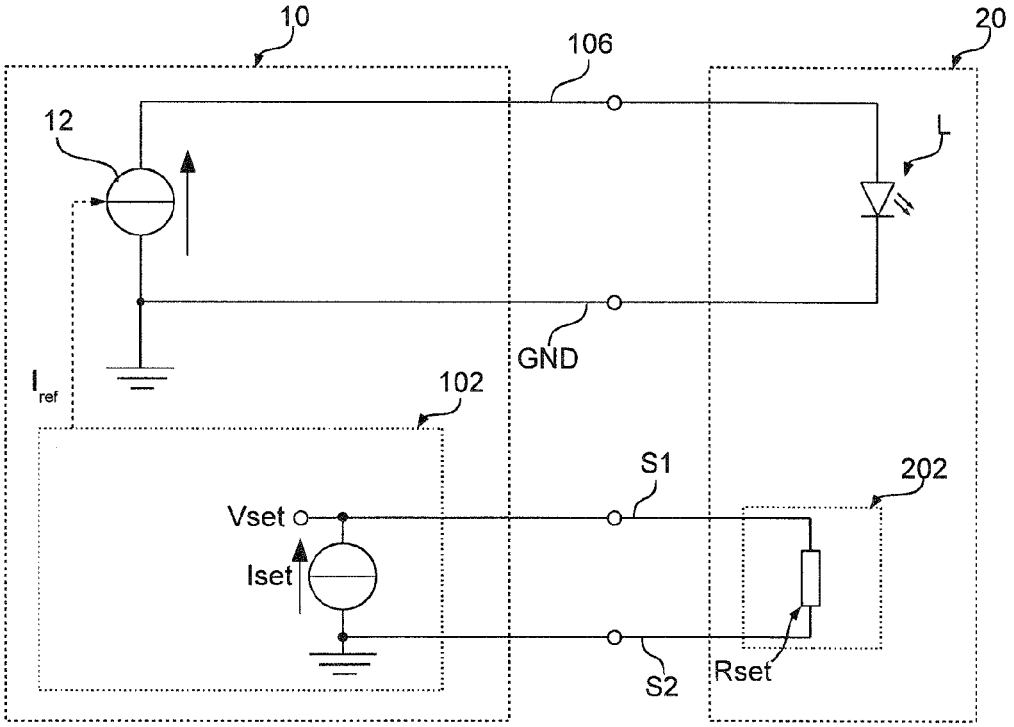
Prior Art Fig. 4
Figure 5:
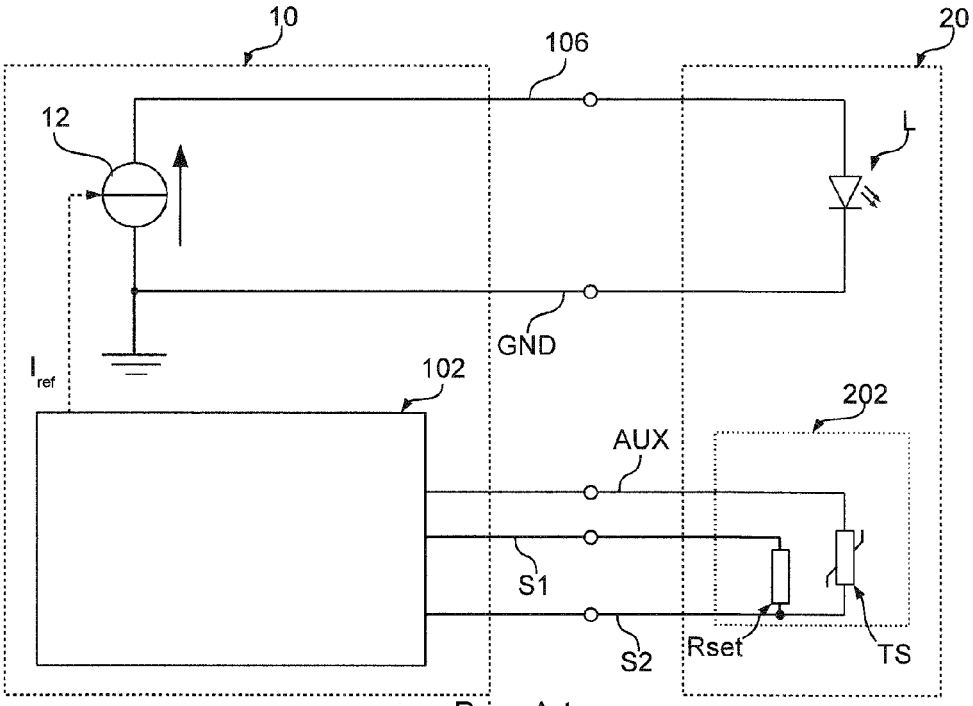
Prior Art Fig. 5
Figure 6:
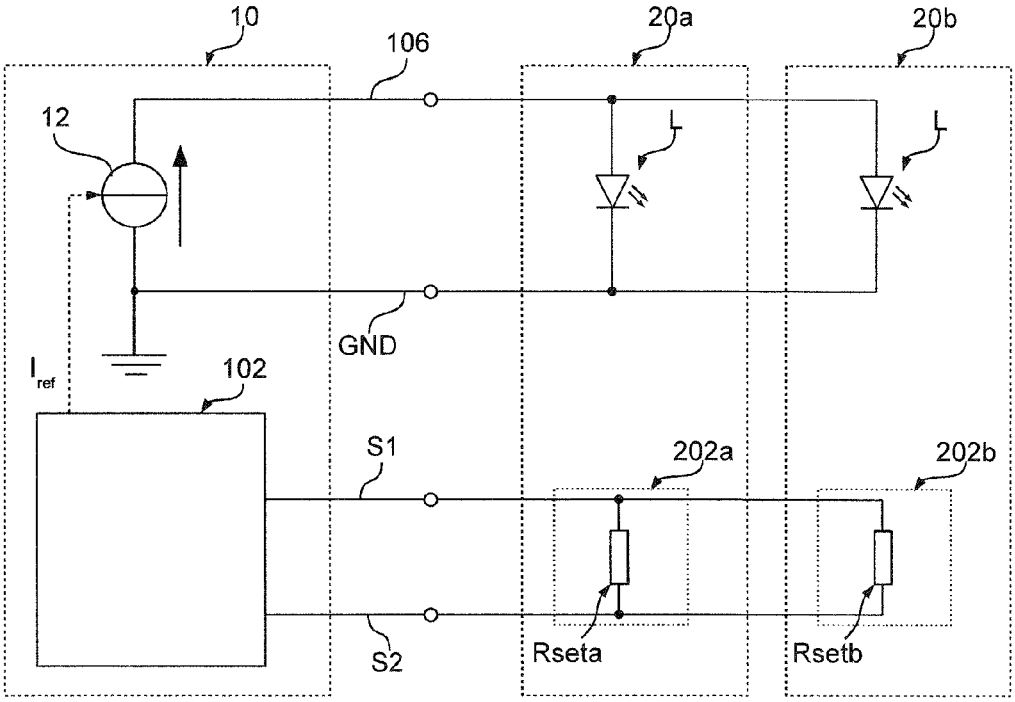
Prior Art Fig. 6
Figure 7:
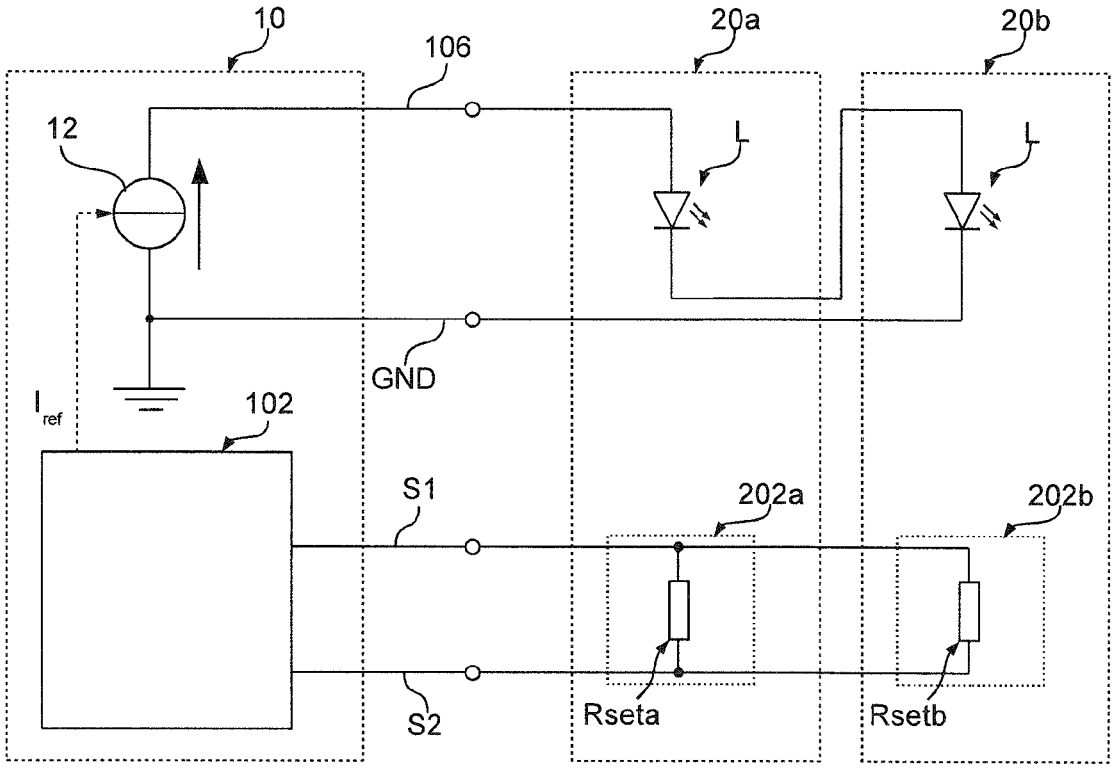

Moreover, according to the present disclosure, the control unit 102 comprises means for detecting the threshold voltage of the Zener diode Z. Generally, any of the control circuits described with respect to FIGS. 3 and 4 could be used for this purpose.

For instance, in the embodiment considered, the line S1 is connected through a pull-up resistor R1 to a constant voltage Vcc. Consequently, when no identification element 202 is connected between the lines S1 and S2, the voltage across the lines S1 and S2 substantially corresponds to Vcc.

Consequently, in one embodiment, the value of the voltage Vcc basically identifies the maximum current that the power circuit 12 is able to supply.

However, in general, the voltage Vcc could even be higher, for example, to verify the presence of a lighting module compatible with the converter 10. In fact, in this case, when the voltage on the line S1 exceeds a preset threshold, the power output 106 could be deactivated. For instance, this threshold could correspond to the maximum current that the power circuit 12 is able to supply.

Instead, when the identification element 202 is connected between the lines S1 and S2, the identification element 202, i.e., the Zener diode Z, sets on the line S1 a voltage that corresponds to the threshold voltage of the Zener diode Z. For instance, the higher is the threshold voltage of the Zener diode Z, the higher is the supply current required by the respective lighting module 20.

Consequently, the control unit 102 can detect the voltage on the line S1, i.e., the threshold voltage of the Zener diode Z, and set the power circuit 12 in such a way that the current supplied on the line 106 corresponds to the current required.

As mentioned previously, the identification element 202 according to the present disclosure can be used when a plurality of lighting modules 20 is connected in series, i.e. when the light sources L of the various lighting modules 20 are connected in series between the power supply terminals 106 of the electronic converter 10.

In various embodiments, the identification elements 202 of the respective lighting modules 20 are connected for this purpose in parallel; i.e., the identification elements 202 are connected in parallel between the measurement terminals S1 and S2 of the electronic converter 10 and the voltage across the lines S1 and S2 is set at the lower threshold voltage.

Figure 9:
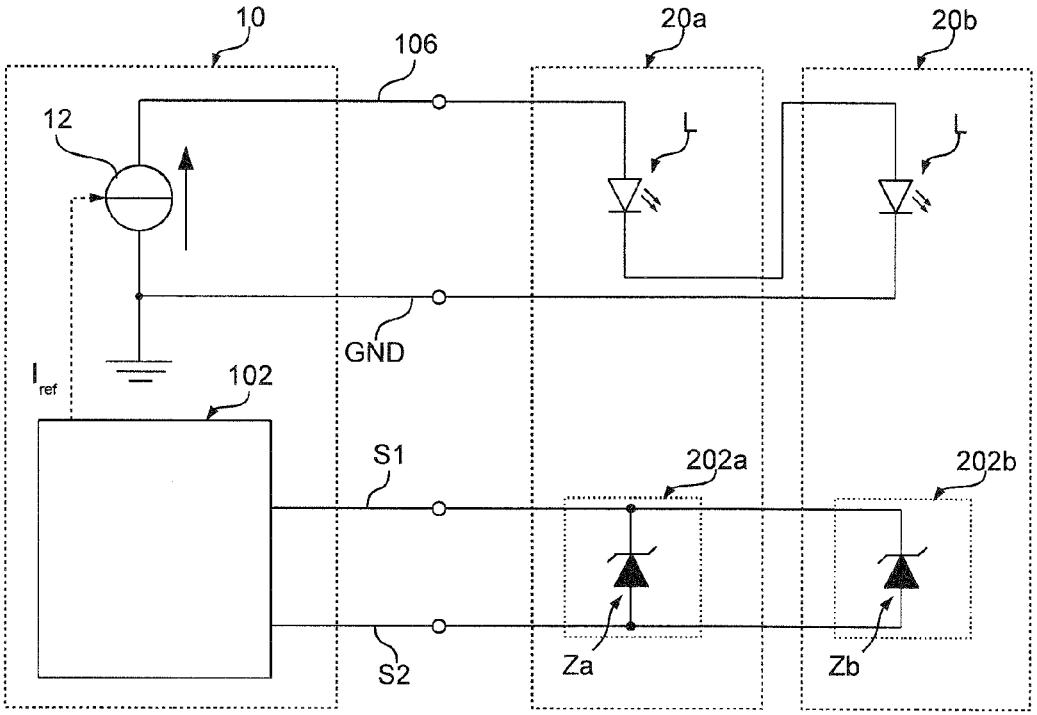

For instance, FIG. 9 illustrates an embodiment in which two lighting modules 20*a* and 20*b* are connected in series, i.e. the respective light sources are connected in series between the power supply lines 106.

Consequently, in the embodiment considered, the respective Zener diodes Za and Zb are connected in parallel, and the voltage on the line S1 corresponds (at the most) to the threshold voltage of the diodes Za and Zb that is lower. For instance, in the case where the lighting module 20*a* were to require a current of 2 A and the lighting module 20*b* were to require a current of 1 A, the Zener diode Za could have a threshold voltage of 2.8 V and the Zener diode Zb could have a threshold voltage of 1.4 V. Consequently, in the case where the voltage Vcc is higher than 1.4 V, the Zener diode Zb would limit the voltage on the line S1 to 1.4 V. As a result, the control circuit 102, once the voltage Vset of 1.4 V has been detected, would set the power circuit 12, e.g. via the current reference signal Iref, in such a way that a current of 1 A is supplied through the power output 106.

Also in this case, the identification element 202 may comprise a temperature sensor. For instance, this may be useful for varying the supply current on the line 106 as a function of the temperature of the lighting module 20 that requires the minimum supply current or for deactivating the supply in the event of overheating of one of the lighting modules 20.

In general, this can be obtained by varying the threshold voltage of the lighting module 20, i.e. the threshold voltage of the respective identification element 202.

Figure 10:
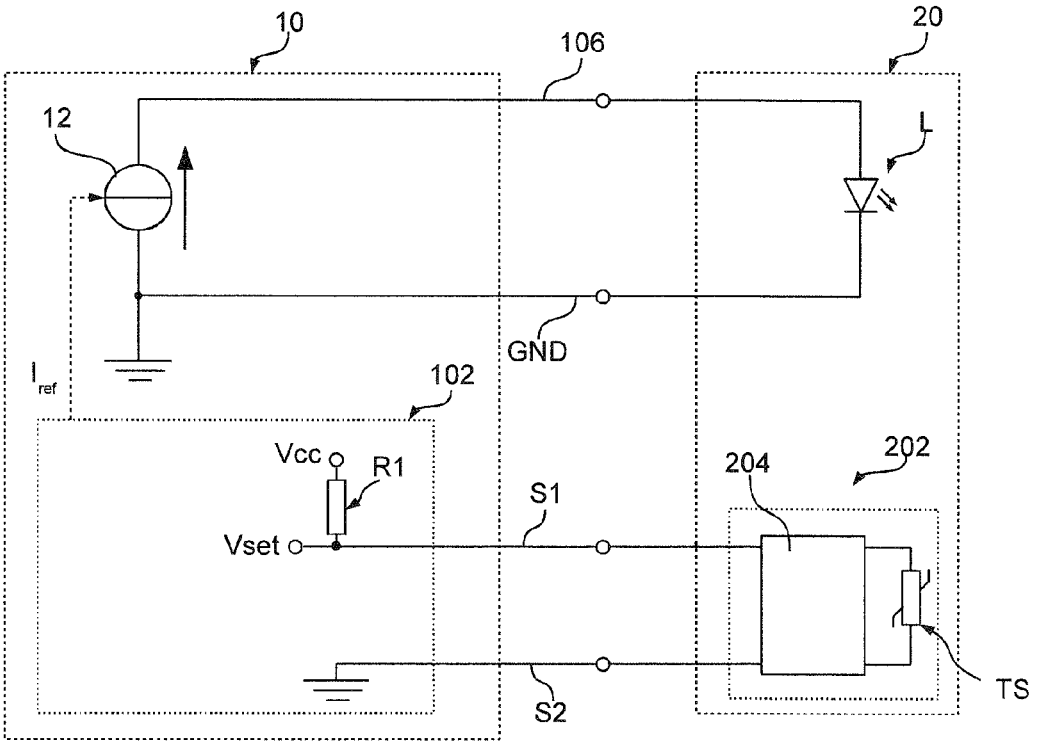

For instance, FIG. 10 illustrates an embodiment, where, instead of the Zener diode Z with constant threshold voltage, a shunt regulator 204 is used, where the threshold voltage of the shunt regulator 204 is set through a temperature sensor TS, such as for example a thermistor of the NTC or PTC type.

However, in general, the identification element 202 could also comprise a Zener diode Z connected in series or preferably in parallel with a shunt regulator 204 (or two shunt regulators connected in parallel). For instance, in this case, the Zener diode Z (or the first shunt regulator) could indicate the nominal current required, and the shunt regulator 204 (or the second shunt regulator) could only intervene when a compensation of heating of the lighting module 20 is necessary.

In general, the variation of the current set point, i.e., of the voltage across the identification element 202, can depend also upon other factors. For instance, instead of a temperature sensor other sensors may also be used, such as:

- a light sensor configured for detecting the ambient luminosity, for example for adjusting the current required on the basis of the light already present, for example to keep the total amount of light constant;
- a twilight sensor, which activates the lighting module only when it is dark;
- a movement or presence sensor comprising, for example, a passive infrared (PIR) sensor, which activates the lighting module only when human presence is detected; and/or
- a wireless receiver, such as for example an infrared receiver, that is able to activate or deactivate the lighting module and/or vary the luminosity of the lighting module on the basis of a signal received from a remote control.

In general, also a plurality of sensors, for example each connected to a respective shunt regulator, can be used together.

As mentioned in the foregoing, the solutions described herein may also be used for deactivating the output current of the power circuit 12, e.g. in the event of overheating of one of the lighting modules.

Figure 11:
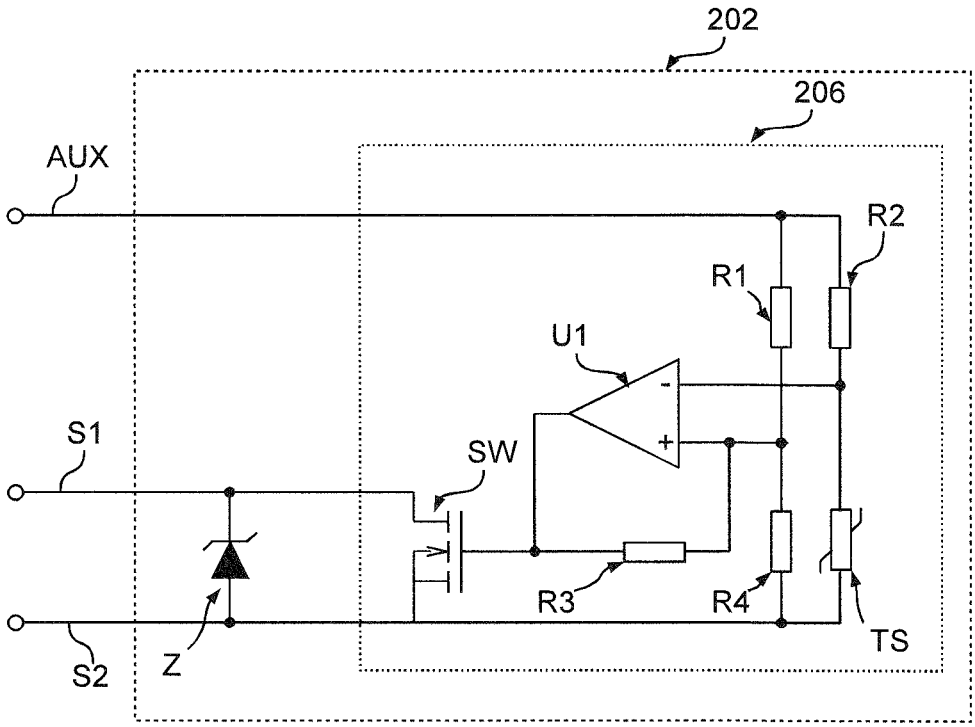

For instance, FIG. 11 illustrates an embodiment with overheating protection.

In the embodiment considered, the identification element 202 comprises a Zener diode Z, where the threshold voltage identifies the nominal current required.

In the embodiment considered, a protection circuit 206 is connected in parallel to the Zener diode Z. In the embodiment considered, this protection circuit 206 is configured for limiting the voltage across the terminals S1 and S2 in response to a signal from at least one sensor. For example, in the embodiment considered, the protection circuit 206 is configured for limiting the voltage across the terminals S1 and S2 to a given voltage when the temperature of the respective lighting module exceeds a given threshold. In particular, this given voltage should be lower than the threshold voltages that are used by the Zener diodes Z that set the respective nominal currents.

In general, also this protection circuit 206 could be a shunt regulator. However, in the case of a simple overheating protection, a complicate shunt regulator with variable threshold voltage is not necessary, but a simple electronic switch is sufficient, such as for example a MOSFET (Metal Oxide Semiconductor Field Effect Transistor), which shortcircuits the lines S1 and S2; namely, the voltage threshold that indicates an overheating corresponds to a voltage Vset of 0 V. Consequently, when the control circuit 102 detects a voltage Vset of 0 V, the control circuit 102 could deactivate the power output 106.

For instance, in the embodiment considered, the protection circuit 106 comprises an electronic switch SW, such as a MOSFET, which is driven via a comparator that compares the temperature of the lighting module with a reference temperature, in which:

- when the temperature is lower than the threshold, the switch SW remains open; and
- when the temperature exceeds the threshold, the switch SW is closed.

For instance, in the embodiment considered:

- the comparator is obtained via an operational amplifier U1 and a resistor R3 on the feedback branch of the operational amplifier U1;
- the reference threshold is set via a first voltage divider R1 and R4, in which the intermediate point of the first voltage divider is connected to the positive terminal of the operational amplifier U1; and
- the temperature is detected via a second voltage divider comprising a resistor R2 and a temperature sensor TS, such as an NTC thermistor, in which the intermediate point of the second voltage divider is connected to the negative terminal of the operational amplifier U1.

In the embodiment considered, the operational amplifier U1 and the voltage dividers (R1 and R4, R2 and TS) are supplied through a constant voltage. Said voltage can be received from the electronic converter 10, for example via a line AUX (see FIG. 11), or can be generated within the lighting module 20, for example by the current supplied on the line 106.

Figure 12:
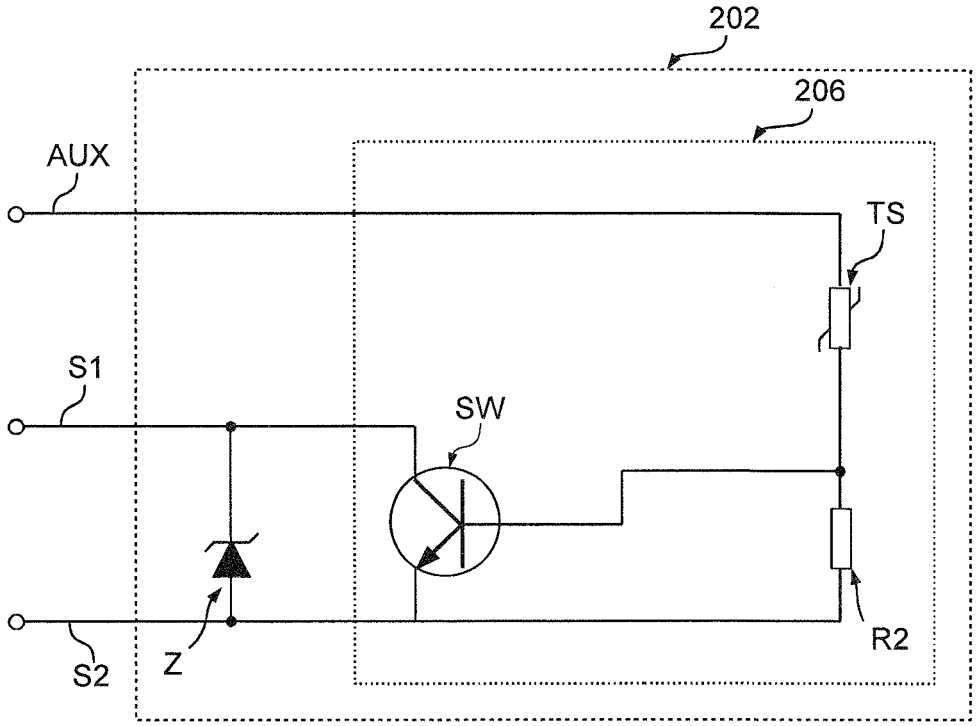

Instead, FIG. 12 shows a second possible embodiment of a protection circuit 206, where a BJT (Bipolar Junction Transistor) is used as electronic switch.

In the embodiment considered, the base of the transistor SW is connected to the intermediate point of a voltage divider once again made up of a temperature sensor TS, such as an NTC thermistor, and a resistor R2. Also in this case, the voltage divider is supplied via a reference voltage, which, as before, may be supplied, for example, by the control unit 102.

However, whereas in the embodiment shown in FIG. 11, the NTC thermistor forms part of the lower branch of the voltage divider, i.e., is connected to ground, in the embodiment shown in FIG. 12, the NTC thermistor forms part of the upper branch of the voltage divider; i.e., it is connected to the reference voltage.

Generally, in case the power supply should only be activated or deactivated, the above embodiments may also be used with other sensors, such as twilight sensors or presence sensors.

Consequently, the solutions described herein enable connection of a plurality of lighting modules in series. In this case, the supply current corresponds to the lower nominal current. Furthermore, the solutions may also be used in combination with other sensors, for example to obtain a temperature compensation and/or an overheating protection.

As shown in the foregoing, the converter 10 is connected to the lighting modules 20 usually via at least four terminals comprising the two power supply terminals 106 and the two measurement terminals S1 and S2. However, as mentioned in the introduction, in case a single lighting module 20 is to be connected to the converter 10, also only three terminals could be used, because the second measurement line S2 could be connected to ground GND.

In general, the solutions described herein may also be used for solving the connection in parallel of the LED strings.

Figure 13:
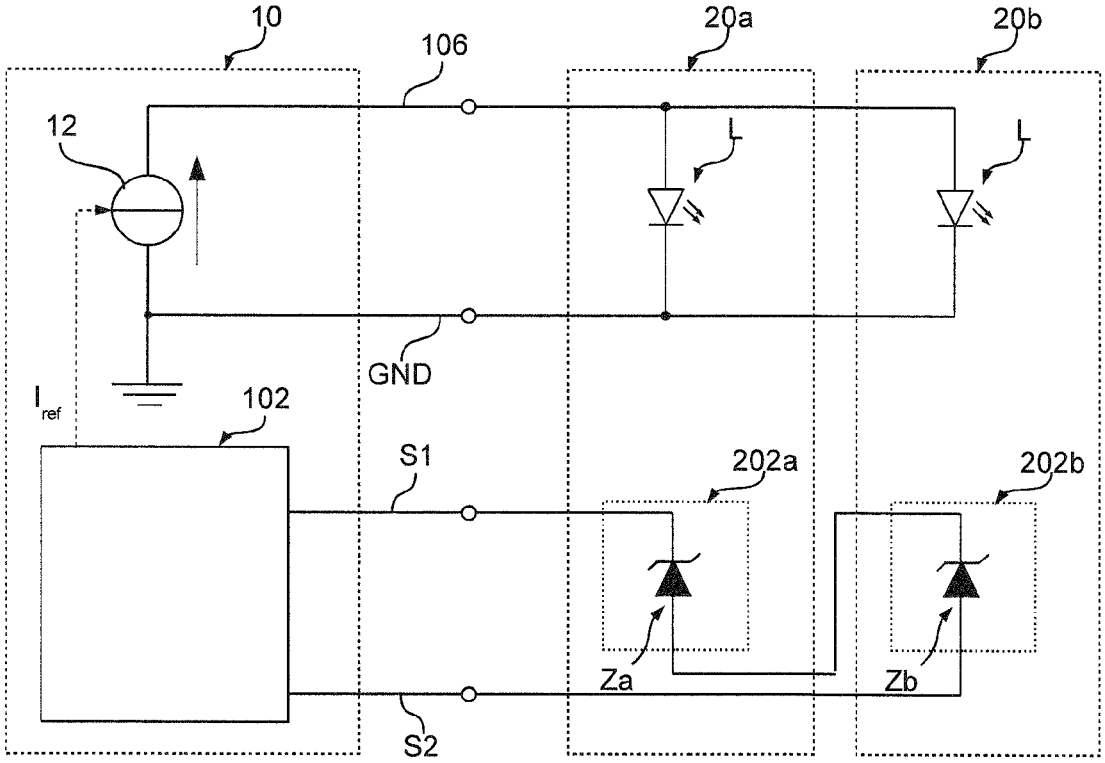

For instance, FIG. 13 shows a possible embodiment of a lighting system, where a plurality of lighting modules 20, for example two modules 20*a* and 20*b*, are connected in parallel; i.e., the light sources L, such as for example LED strings, are connected in parallel, i.e. the light sources L are connected in parallel between the power supply terminals 106 of the electronic converter 10.

In this case, the respective identification elements 202 of the lighting modules 20 are connected in series, i.e., the respective voltage references 202, for example the Zener diodes Za and Zb or the equivalent shunt regulator, are connected in series, i.e. the identification elements 202 are connected in series between the measurement terminals S1 and S2 of the electronic converter 10.

In this way, the voltage across each identification element 202 can identify the supply current required by the respective lighting module 20. Consequently, the currents required by the various lighting modules 20 are added, and the current generator 12 supplies a current that is equal to the sum of the individual currents required.

Consequently, the solutions described herein can be used for solving both the connection in parallel and the connection in series of a plurality of lighting modules 20.

Of course, without prejudice to the principle of the invention, the details of construction and the embodiments may vary even significantly with respect to what has been illustrated herein purely by way of non-limiting example, without thereby departing from the scope of the invention, as defined by the annexed claims.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A lighting system comprising:

a plurality of lighting modules, wherein each lighting module comprises:

at least one light source; and an identification element configured to identify the supply current required by each of the at least one light source, wherein the identification element comprises a first terminal and a second terminal for connection to an electronic converter, wherein the identification element of each of the plurality of lighting modules comprises at least one regulator configured to limit the voltage across the first terminal and the second terminal of each of the plurality of lighting modules to a maximum threshold, wherein the maximum threshold identifies the supply current required by the at least one light source of each of the plurality of lighting modules;

an electronic converter, comprising:

a control circuit configured to detect a voltage across the first terminal and the second terminal; and a power circuit configured to supply the at least one light source of the plurality of lighting modules, wherein the power circuit is configured to supply a current as a function of the voltage detected across the first terminal and the second terminal; and wherein:

the light sources of said lighting modules are connected in series and the identification elements of said lighting modules are connected in parallel; or the light sources of said lighting modules are connected in parallel and the identification elements of said lighting modules are connected in series.

2. The lighting system according to claim 1, wherein at least one of said regulators is a Zener diode or a shunt regulator, such as an LM431 integrated circuit or the equivalent.

3. The lighting system according to claim 1, wherein at least one of said regulators is configured to vary its maximum threshold voltage as a function of a signal detected by a sensor.

4. The lighting system according to claim 3, wherein said sensor comprises:

a temperature sensor configured to detect the temperature of said lighting module and/or of said at least one light source;

a light sensor configured to detect the ambient luminosity;

a twilight sensor;

a movement sensor; and/or a wireless receiver configured to receive a signal from a remote control.

5. The lighting system according to claim 3, wherein at least one identification element of the plurality of lighting modules comprises:

a first regulator and a second regulator configured to limit the voltage across the first terminal and the second terminal of the respective lighting module to a maximum threshold voltage, wherein the second regulator is connected in parallel with the first regulator, and wherein:

the maximum threshold voltage of the first regulator identifies the nominal current required by the at least one light source; and the second regulator is configured to vary its maximum threshold voltage as a function of the signal detected by the sensor.

6. The lighting system according to claim 1, wherein at least one identification element of the plurality of lighting modules comprises an electronic switch connected between said first terminal and said second terminal of the respective lighting module, and wherein said identification element is configured to close said electronic switch as a function of a signal detected by a sensor.

7. The lighting system according to claim 6, wherein said identification element is configured to close said electronic switch when the temperature of said lighting module and/or of said at least one light source exceeds a temperature threshold.

8. The lighting system according to claim 1, wherein said control circuit comprises a resistor connected between a reference voltage and said first terminal, and wherein said second terminal is connected to ground.

9. The lighting system according to claim 1, wherein said control circuit is configured to deactivate the current supplied by said power circuit when the voltage detected between said first terminal and said second terminal is lower than a first threshold and/or higher than a second threshold.

10. The lighting system according to claim 1, wherein said electronic converter comprises at least two power supply terminals, wherein said power circuit is configured to supply said at least one light source of the plurality of lighting modules via the power supply terminals.

11. The lighting system according to claim 10, wherein:

the light sources of said lighting modules are connected in series between said power supply terminals of said electronic converter, and wherein the identification elements of said lighting modules are connected in parallel between the first terminal and the second terminal; or the light sources of said lighting modules are connected in parallel between said power supply terminals of said electronic converter, and wherein the identification elements of said lighting modules are connected in series between the first terminal and the second terminal.

* * * * *